US007845136B1

(12) United States Patent
Sorkin

(10) Patent No.: US 7,845,136 B1
(45) **Date of Patent: *Dec. 7, 2010**

(54) EXPANSION-RESISTIVE CONSTRUCTION CHAIR FOR USE WITH TILT-WALL CONSTRUCTION

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 830 days.

This patent is subject to a terminal disclaimer.

(21) Appl. No.: 11/619,545

(22) Filed: Jan. 3, 2007

Related U.S. Application Data

(63) Continuation-in-part of application No. 10/688,184, filed on Oct. 20, 2003, now Pat. No. 7,237,367.

(51) Int. Cl.
*E04C 5/16* (2006.01)

(52) U.S. Cl. ..... 52/687; 52/689

(58) Field of Classification Search ..... 52/677–689, 52/700, 105; 404/134–136; 8/354, 380; 248/599–600, 649, 440.1
See application file for complete search history.

(56) References Cited

U.S. PATENT DOCUMENTS

| | | | | | |
|---|---|---|---|---|---|
| 4,000,591 | A | | 1/1977 | Courtois | |
| D271,846 | S | * | 12/1983 | Hernandez | D8/356 |
| D271,847 | S | * | 12/1983 | Hernandez | D8/356 |
| 4,682,461 | A | * | 7/1987 | Sizemore | 52/689 |
| 5,555,693 | A | | 9/1996 | Sorkin | |
| 5,791,095 | A | * | 8/1998 | Sorkin | 52/105 |
| 6,089,522 | A | * | 7/2000 | Haslem et al. | 248/440 |
| D500,668 | S | * | 1/2005 | Kelly et al. | D8/354 |
| D595,117 | S | * | 6/2009 | Sorkin | D8/354 |
| 2005/0210816 | A1 | * | 9/2005 | Kelly et al. | 52/677 |

FOREIGN PATENT DOCUMENTS

| | | |
|---|---|---|
| AU | 227969 | 11/1959 |
| GB | 575043 | 1/1946 |

* cited by examiner

*Primary Examiner*—Jeanette Chapman
(74) *Attorney, Agent, or Firm*—Egbert Law Offices PLLC

(57) ABSTRACT

A chair has a receiving area and a plurality of legs extending downwardly from the receiving area. Each of the plurality of legs has a first portion extending at an angle outwardly from the receiving area and a second portion extending vertically from an end of the first position opposite the receiving area. The second portion extends vertically downwardly. A plurality of pin members are respectively formed at a bottom of the plurality legs. Each of the plurality of pin members extends downwardly from a bottom of second portion opposite the first portion so as to have a pointed end opposite the bottom of the second portion. The first portion has a length substantially longer than a length of the second portion.

16 Claims, 3 Drawing Sheets

EXPANSION-RESISTIVE CONSTRUCTION CHAIR FOR USE WITH TILT-WALL CONSTRUCTION

CROSS-REFERENCE TO RELATED U.S. APPLICATIONS

The present application is a continuation-in-part of U.S. application Ser. No. 10/688,184, filed on Oct. 20, 2003, and entitled "Construction Chair for use with Tilt Wall Construction", presently pending.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to chairs and spacers that are used in construction activities for the support of post-tension cables, rebars, or mesh. More particularly, the present invention relates to chairs of plastic construction that are used for the support of such materials in poured decks and precast work. Specifically, the present invention relates to chairs that are used in tilt wall construction.

2. Description of Related Art Including Information Disclosed Under 37 CFR 1.97 and 37 CFR 1.98.

Chairs are commonly used in the construction industry for the support of post-tension cables, rebars, and mesh above a surface. Typically, when such materials are used, they must be supported above the surface when the concrete is poured. Chairs are used with poured decks, precast work, and slab-on-grade applications. In normal use, a receiving area formed on the chair will contact and support the rebar while the base of the chair rests on a deck or on a grade. When the concrete is poured, the chair will support the post-tension cable or rebar a proper distance above the bottom surface.

In deck applications, the most common chair that is employed is a metal chair manufactured by Meadow Steel Products of Tampa, Fla. This chair is made from a pair of bent wires. A first bent wire has a receiving area for the receipt of the rebar. The receiving area is bent into the wire so as to form a generally parabolic indentation. The ends of the wire are bent at a ninety degree angle so as to support the wire in an upright condition above the deck. A second wire is formed in an inverted U-shaped configuration and is welded to the bottom edge of the receiving area of the first wire. The second wire also has ends that are bent at generally ninety degree angles. The first wire will extend in a plane transverse to the second wire such that the first and second wire form the "legs" of the chair. The ends of each of these wires will rest on the deck while the cable is supported. After the concrete has solidified, the deck is removed, and the bottom surfaces of the ends of the wire are exposed. As such, it is necessary to coat the ends of the wires with an anti-rust material. The rebar can be tied to the receiving area.

In normal applications, this Meadow Steel Products' chair will support a single rebar above the deck for a desired distance. However, in other applications, it is often desirable to place a second smaller chair beneath the larger chair so that another additional rebar can be extended so as to intersect with the first rebar. The chairs come in a large number of sizes and heights. In some circumstances, it is often desirable to place more than one rebar into the receiving area of the chair. To accommodate this problem the receiving area of the chair has a generally parabolic indentation.

Corrosion and cost are major problems affecting the Meadow Steel Products' chair. In order to form such a chair, a great deal of manufacturing must take place, including metal forming, bending, dipping, and welding. These activities, along with the cost of the material used to form the chair, make the cost of the chair relatively expensive. If the Meadow steel chair is not coated, then corrosion can adversely affect the product. Such corrosion can occur even on coated metal chairs.

In the past, many attempts have been made to create chairs of plastic material that can serve the purposes of the Meadow Steel Products' chair. In general, such efforts have resulted in plastic chairs that are ineffective, cumbersome to use, or unable to withstand the forces imparted by the cable upon the chair. In some cases, support rings and other structures have been placed upon the plastic chairs so as to give the chair sufficient strength. Unfortunately, as such structures are added to the plastic chair, it becomes increasingly difficult to tie the rebar to the receiving area of the chair. This often requires a threading of the wire through the interior of the plastic chair in order to tie the rebar. As a result of this complicated procedure, many construction workers have been unwilling to use such plastic chairs. Additionally, the interior structures and support rings of such plastic chairs eliminate the ability to extend the rebars in an intersected relationship because one chair cannot be stacked upon or over another.

The plastic chairs of the past have often broken, collapsed, or tipped over in actual use. In the case of the plastic chairs, the base of the chair has only a small area of contact with the deck. Even with the necessary internal structure, experience has shown that such plastic chairs fail to withstand the weight of the rebar.

One particular type of plastic chair that has had some success is manufactured by Aztec Concrete Accessories, Inc. of Fontana, Calif. This chair has a plurality of legs that extend downwardly from a central receiving area. The central receiving area has a generally semi-circular configuration that can receive only a single rebar. An annular ring extends around the legs of the chair so as to provide the necessary structural support for the chair. The feet of the chair extend inwardly of the ring. In use, these chairs have had a tendency to tip over. Additionally, these chairs fail to accommodate the need to align rebars in an intersecting relationship. The use of the annular ring extending around the legs of the chairs requires that a wire must be threaded through the interior of the chair in order to tie the rebar within the receiving area. As such, these chairs have been generally ineffective for meeting the needs of the construction industry. In the past, these and other plastic chairs have been unable to withstand the loads placed upon them. As such, breakage and insufficient rebar support has resulted.

In the past, various U.S. and foreign patents have issued on various devices relating to chairs. For example, U.S. Pat. No.

4,000,591, issued on Jan. 4, 1977, to P. D. Courtois describes a holder adapted for supporting an anchor insert to be embedded into a concrete slab. The holder includes an enclosure, a plurality of legs extending from the enclosure, and a foot at the outer end of each leg adapted with the remaining feet to support the enclosure in a spaced relationship above the floor of a concrete form. The enclosure includes a seat adapted for supporting an insert with the foot of the insert seated thereon. This holder device is not designed supporting rebars in concrete.

British Patent No. 575,043, issued on Jan. 31, 1946, to K. Mattson, teaches a chair-like device that is intended for use in supporting a tendon above the floor of a slab. The support includes a clip formed at the receiving area so as to snap onto the exterior surface of a tendon. Various circular openings are formed in the body of this chair so as to allow tendons to be extended therethrough in parallel and transverse relationship.

Australian Patent No. 227,969, published on Nov. 19, 1959, to Keith Douglas Moris describes a reinforcing chair which includes a plurality of legs extending downwardly from a cruciform receiving area.

Chairs present a particular problem when used in tilt-wall construction. In such circumstances, the chairs are often referred to as "spacers" which are utilized in the forming of the walls of a building by using such concrete tilt-up structures. With prior art metallic rebar chairs, after the concrete wall is poured and properly sets, all spacer and chair locations are checked for exposure of any portion of the chair at the surface of the wall. All of such exposed metallic edges are ground and then sealed to protect from the formation of rust, which attacks the metal of the rebar or chair on the interior of the wall and causes structural weaknesses. In addition, in tilt-wall construction, the metal from the chair can rust and eventually bleed into the concrete of the outer wall. This recreates an unsightly and unprofessional appearance of the concrete structure. As such, a need has developed so as to protect structure from the corrosion of chairs.

A particular problem associated with the use of such plastic chairs in tilt-up construction is the difference in the coefficient of thermal expansion of plastic as opposed to concrete. This is particularly the case when the separate chairs are sprayed with bond breaker compounds prior to the placement of the concrete upon the chairs. Bond breaker compounds are intended to break the seal that can be established between the form boards and concrete used for the formation of the wall. Often, the chairs are sprayed at the same time that the form is sprayed with the bond breaker. As a result, the chair will not adequately adhere directly to the concrete within the structure. Because plastic has a coefficient of expansion greater than the coefficient of expansion of concrete, heat will tend to cause the plastic to expand for a greater distance than the concrete. As a result, the plastic chairs can expand so as to protrude outwardly of the wall subsequent to installation. This is particularly the case when the plastic chair has been coated with a bond breaker compound. As such, a need has developed so as to minimize the expansion of the chair relative to the concrete structure.

The present inventor is also the inventor of the subject matter of U.S. Pat. No. 5,791,095, issued on Aug. 11, 1998, and U.S. Pat. No. 5,555,693, issued on Sep. 17, 1996. Each of these prior patents describes a chair having a receiving area with a horizontal section and generally parabolic section extending transverse to the horizontal section. A plurality of separate legs extend downwardly from the receiving area. Each of the legs has a foot extending horizontally outwardly therefrom. The receiving area on the plurality of legs is integrally formed together of a polymeric material. The horizontal section and the generally parabolic section have a cruciform configuration. Each of the legs has a rectangular cross section in a horizontal plane.

In the chair described in U.S. Pat. Nos. 5,555,693 and 5,791,095 issued to the present inventor, a plurality of small pin members extends downwardly from the bottom surface of each of the feet of the chair. This pin surface has a pointed end and an inward end joined to the underside of the foot. This construction of a pin member created complexities during the injection molding of the chair. For example, the very small spaces used for the formation of such small pin members was difficult to develop. Additionally, because the pin members are directly connected to the underside of the foot, there is no supporting surface extending outwardly from the underside of the foot. As a result, the pointed end of the pin members could easily deflect and could be ineffective in properly grasping the underlying surface. Each of these prior art patents describes the use of three pin members on the underlying surface of each foot. Experiments with the product associated with these patents have indicated that fewer pin members than those indicated in these patents could achieve the same purpose of proper placement and holding capability as the three pin version.

It is an object of the present invention to provide a chair that is corrosion-proof and relatively inexpensive.

It is another object of the present invention to provide a chair that facilitates the ability to stack the chairs.

It is a further object of the present invention to provide a chair that withstands the forces imparted on it.

It is a further object of the present invention to provide a chair that is easy to manufacture and easy to use.

It is still another object of the present invention to provide a chair that has a receiving area that can accommodate several rebars.

It is another object of the present invention to provide a chair with a pin member extending outwardly from a bottom surface of the leg.

It is another object of the present invention to provide a chair which distributes the downward force of the weight of the rebar over a larger surface area.

It is a further object of the present invention to provide a chair for use in tilt-wall construction which minimizes the adverse effects of thermal expansion upon the chair.

It is still a further object of the present invention to provide a chair which resists the adverse effect of the application of bond breaker to the chair.

These and other objects and advantages of the present invention will become apparent from a reading of the attached specification and appended claims.

BRIEF SUMMARY OF THE INVENTION

The present invention is a construction chair that comprises a receiving area, a plurality of legs extending downwardly from the receiving area, and a plurality of pin members respectively formed at a bottom of the plurality of legs. Each of the plurality of legs has a first portion extending at an angle outwardly from the receiving area and a second portion extending from an end of the first position opposite the receiving area. The second portion extends entirely vertically. The plurality of pin members extend downwardly from a bottom of the second portion opposite the first portion so as to have a pointed end opposite the bottom of the second portion. The first portion has a length substantially longer than a length of the second portion.

In the present invention, the first portion has an inner side and an outer side. Similarly, the second portion has an inner side and an outer side. The inner side of the first portion extends at a non-linear obtuse angle with respect to the inner side of the second portion. The outer side of the first portion extends at a non-linear obtuse angle with respect to the outer side of the second portion. Each of the plurality of legs has a rectangular cross section.

Each of the plurality of pin members extends from the inner and outer sides of the second portion. The plurality of pin members have generally flat sides. The inner and outer sides of the first portion of the leg converges toward the second portion. The inner and outer sides of the second portion are substantially parallel.

In the present invention, the receiving area and the plurality of legs and the plurality of pin members are integrally formed together of a polymeric material.

Fundamentally, in the present invention, the verticality of the second portion of the leg, along with the non-linearity of the inner and outer sides of the each of the legs properly serves to buttress the legs against the forces of thermal expansion. Only the small length of the second portion of the leg is subject to being thermally expanded. The small length of the second portion will minimize the amount of thermal expansion and, as a result, minimize any creeping of the pin members outwardly of the tilt wall.

DETAILED DESCRIPTION OF THE INVENTION

Figure 1:
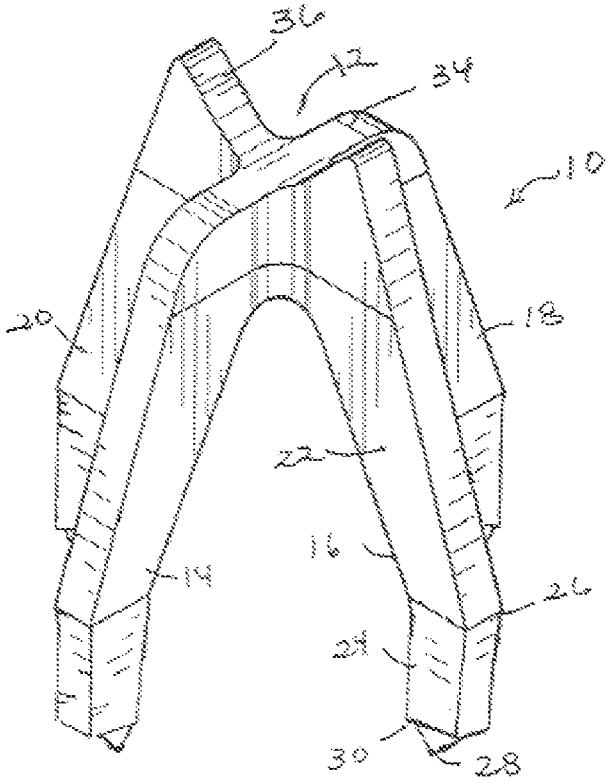
FIG. 1 is a perspective view showing the chair in accordance with the preferred embodiment of the present invention.

Referring to FIG. 1, there is shown the construction chair 10 in accordance with the preferred embodiment of the present invention. The chair 10 includes a receiving area 12, and a plurality of legs 14, 16, 18 and 20 extending downwardly from the receiving area. Each of the plurality of legs 14, 16, 18 and 20 is of generally identical configuration below the receiving area 12. In particular, each of the plurality of legs includes a first portion 22 extending outwardly at an angle away from the receiving area 12 and a second portion 24 extending from the end 26 of the first portion 22 opposite the receiving area 12. The second portion 24 extends vertically downwardly from the end 26 of the first portion 22.

As can be seen in FIG. 1, the first portion 22 has a length that is substantially greater than a length of the second portion 24. A pin member 28 extends outwardly from the flat bottom surface 30 of the second portion 24.

In normal use, it can be seen that the first portion 22 has a substantially greater length than the second portion 24. Additionally, although the first portion 22 extends outwardly downwardly the second portion 24 extends vertically downwardly. As a result, when the chair 10 is placed into the concrete, and after the concrete has solidified, any expansion effects will tend to cause the surfaces of each of the legs 14, 16, 18 and 20 to abut the solidified concrete and urge the expansion effects of the legs to be greatly absorbed by the extended length of the first portion 22. As a result, the receiving area 12 will tend to rise or lower within the concrete as a result of expansion effects. The pins 28 on the flat bottom surface 30 of the smaller second portion 24 will strongly resist the expansion forces or expand relatively minimally, as a result of the short length of such second portion 24. A illustration of the expansion effects relative to the prior art and to the present invention are illustrated, respectively, in FIGS. 6 and 7.

The receiving area 12 has a horizontal section 34 and a parabolic section 36. The parabolic section 36 extends generally transverse to the horizontal section 34. Leg 14 extends downwardly from one end the horizontal section 34. Leg 18 extends downwardly from an opposite end of the horizontal section 34. Leg 16 extends downwardly from one end of the generally parabolic section 36. Leg 20 extends downwardly from an opposite end of the generally parabolic section 36. Legs 14 and 18 are in generally coplanar alignment. Similarly, legs 16 and 20 are in coplanar alignment. The legs 14, 16, 18 and 20 are separated from each other and are unconnected to an adjacent leg in an area below the receiving area 12. As a result, the present invention avoids the need to have any additional support structure located below the receiving area 12. Past experience has shown that any supporting structure, such as in the nature of rings, struts, cross member or other structures that is located below the receiving area 12, would tend to create fall out within the concrete by having inadequate connection between the bulk of the concrete structure and that small portion of the concrete structure located in the area within the chair 10. As a result, the present invention effectively avoids this fall-out effect.

In the present invention, the receiving area 12, along with the legs 14, 16, 18 and 20, are integrally formed together of a polymeric material, such as nylon.

Figure 2:
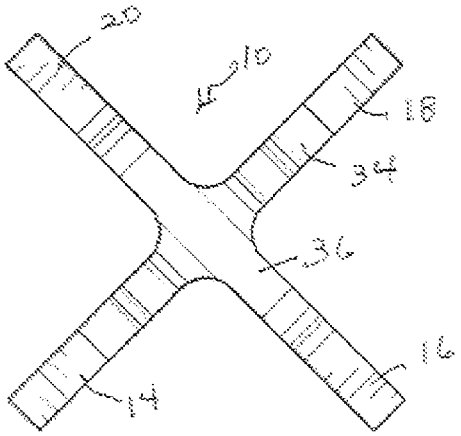
FIG. 2 is a top view of the chair in accordance with the teachings of the present invention.

FIG. 2 shows a top view of the chair 10. As can be seen, the leg 18 extends in coplanar relationship with the horizontal surface 34. Also, leg 14 extends in coplanar relationship with the horizontal surface 34. The generally parabolic surface 36 has leg 16 extending therefrom and also leg 20 extending therefrom. It can be seen that a cross section of the chair 10 has a cruciform shape. Each of the legs 14, 16, 18 and 20 are illustrated as having a generally rectangular cross section.

Figure 3:
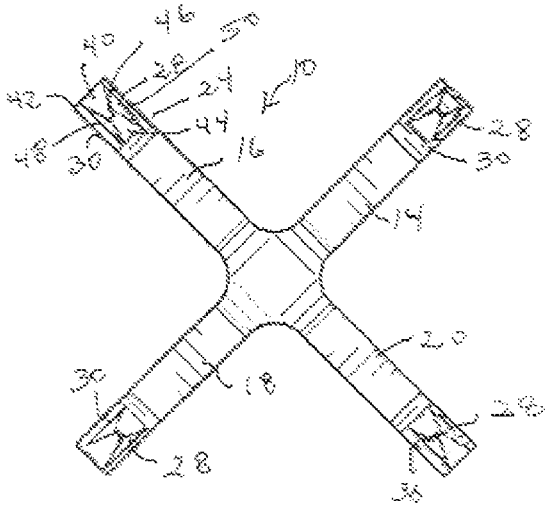
FIG. 3 is a bottom view of the chair in accordance with the teachings of the present invention.

FIG. 3 illustrates the bottom of the chair 10. Pin members 28 are illustrated at the bottom of each of the legs 14, 16, 18 and 20. Each of pin members 28 extends from the flat bottom surface 30 of each of the legs 14, 16, 18 and 20. Each of the pin members 28 has a generally unique configuration. As can be seen, there is a surface 40 that extends from the outer side 42 of the bottom 30 of the second portion 24. There is another surface 44 that extends outwardly from the flat bottom surface 30 so as to converge at a point 46. Sides 48 and 50 are generally flat sides and generally converge toward one another at a point 46. This configuration of the pin member enhances the ability of the chair 10 to reside on a decking material while, at the same time, facilitating the ability to manufacture the chair. Flat surfaces relating to pin member 28 are simpler to machine within the tooling than conical-shaped pin members. Additionally, the flat surfaces 40, 44, 48 and 50 are also slightly resistive of thermal expansion effects. They will tend to bond more securely with the concrete which extends therearound and, hence, transfer any expansion force upwardly rather than downwardly.

Figure 4:
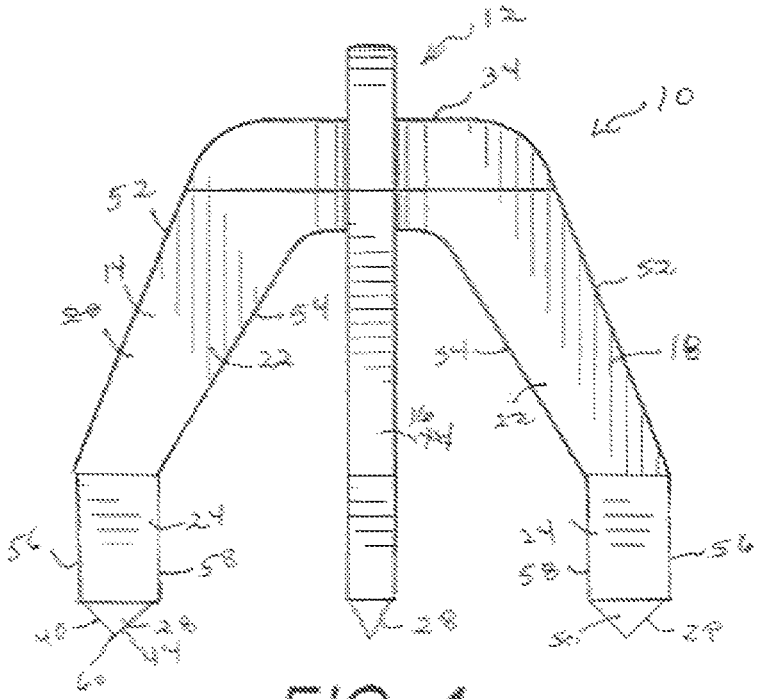
FIG. 4 is a side elevational of the chair in accordance with the teachings of the present invention.

FIG. 4 illustrates a side elevational view of the chair 10. In FIG. 4, the legs 14 and 18 extend downwardly and outwardly from the horizontal surface 34 of receiving area 12. Each of the legs 14 and 18 includes a first portion 22 and a second portion 24. The first portion 22 has a flat outer side 52 and a flat inner side 54. Similarly, the second portion 24 has a generally flat outer side 56 and a flat inner side 58. Pin members 28 extend downwardly from the bottom of the second portion 24. Importantly, in the present invention, each of the legs 14 and 18 has a discontinuity along its length. In particular, the outer side 56 of the second portion 24 extend at a non-linear obtuse angle with respect to outer side 52 of the first portion 22. The inner side 58 of the second portion 24 extends at a non-linear obtuse angle with respect to the inner side 54 of the second portion 22. It can be seen that the outer side 56 is in generally parallel relationship with the inner side 58 of the second portion 24. The second portion 24 is illustrated as extending entirely vertically along its length. The pin member 28 has surface 40 extending inwardly from the outer surface 56 of the second portion 24. Similarly, surface 44 extends outwardly from the inner surface 58 of the second portion 24. Each of the surfaces 40 and 44 meet so as to form the point 60 at an end opposite the second portion 24. It can be seen that the side 50 of the pin member 28 is generally flat and has a triangular shape.

Figure 5:
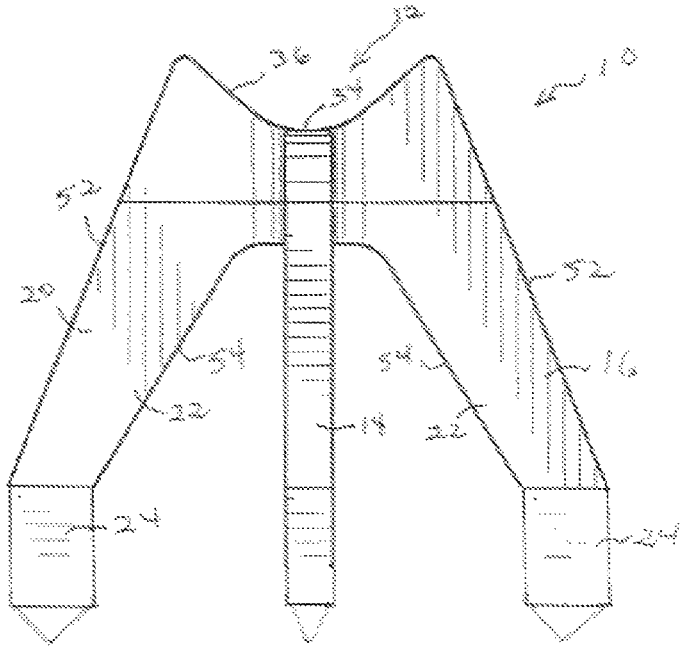
FIG. 5 is an end view of the chair in accordance with the teachings of the present invention.

FIG. 5 illustrates the end view of the chair 10 of the present invention. As can be seen, legs 16 and 20 extend outwardly and downwardly from the generally parabolic surface 36 of the receiving area 12. Leg 14 is illustrated as extending downwardly from the horizontal surface 34. Each of the legs 16 and 20 has a generally identical construction to that of legs 14 and 18, as illustrated in FIG. 4. In FIG. 5, it can be seen that the outer side 52 and the inner side 54 of the first portion 22 of legs 16 and 20 generally converge toward the second portion 24.

Figure 6:
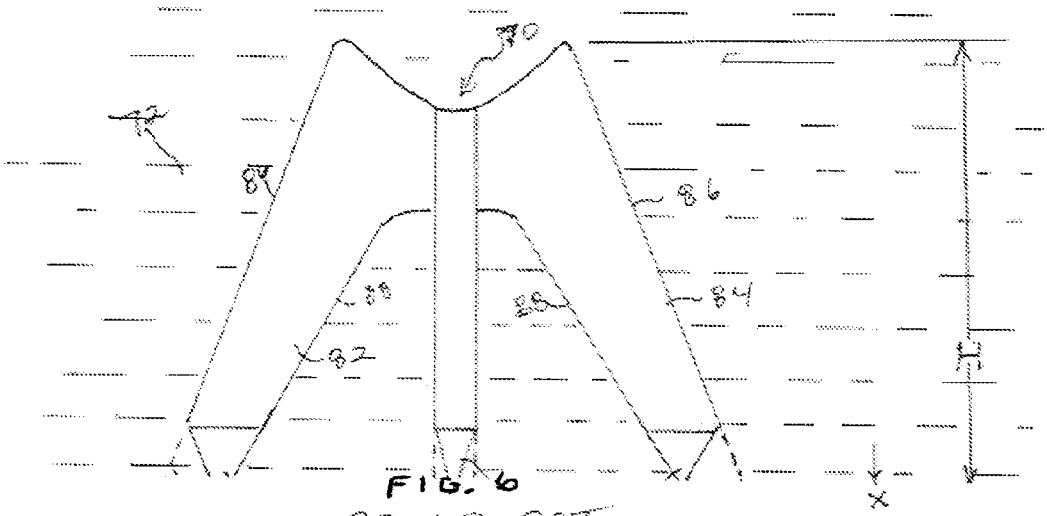
FIG. 6 PRIOR ART
FIG. 6 is an illustration of the prior art chair as embedded in concrete and showing, in broken line fashion, the thermal expansion of the chair outwardly beyond the wall.

FIG. 6 illustrates the problems associated with the prior art chairs as used in tilt-wall construction. In particular, FIG. 6 shows a prior art chair 70 that is embedded in concrete 72. The wall 74 of concrete 72 generally supports the chair 70 at the pin members 76, 78 and 80. Typically, the wall 74 will be formed by pouring the concrete 72 upon an underlying surface, such as a deck. The pointed ends of the pin members 76, 78 and 80 will rest upon the deck as the concrete is poured. As such, the pointed ends of pin members 76, 78 and 80 will be flush with the wall 74 when the concrete 72 has solidified.

It can be seen that the legs 82 and 84 of chair 70 have generally continuous outer sides 86 and inner sides 88. Each of the legs 82 and 84 has a height (H). The height of the chair 70 is representative of the length of the legs 82 and 84. In fact, because the legs 82 and 84 extend at an angle, they will be slightly longer than the height H of the chair 70. Typically, the polymeric material used for chair 10 will have a thermal expansion coefficient that is approximately ten times the thermal expansion coefficient of concrete. As such, for every millimeter that the concrete 72 expands, the polymer used for chair 70 will expand by ten millimeters. In FIG. 6 it can be seen that, when heat is applied, the thermal expansion will cause the legs 82 and 84 to lengthen by a distance "X". As a result, the pin member 76, 78 and 80 will tend to creep outwardly of the wall 74 for the distance "X". This thermal expansion is typically only a problem when bond breakers are applied to the chairs. Since the chair does not adequately adhere directly to the concrete within the structure, the thermal expansion and the linearity of sides 86 and 88 of the legs 82 and 84 will cause the plastic to expand outwardly for a greater distance than the concrete. As such, portions of the chair 70 can protrude outwardly of the wall subsequent to installation. Since it is virtually impossible to ensure that bond breakers are not applied to the chair during the construction activities, the thermal expansion of the chair 70 is an area of important concern.

Figure 7:
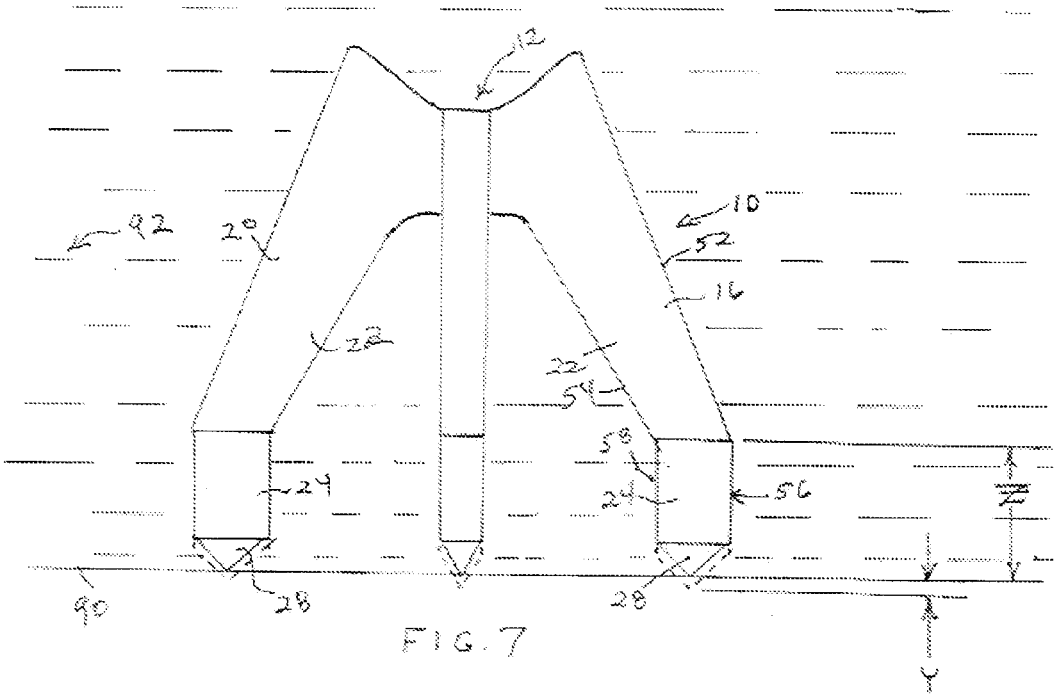
FIG. 7 illustrates the present invention as embedded in concrete and illustrated, in broken line fashion, the expansion.

FIG. 7 shows how the chair 10 of the present invention resists thermal expansion effects and will serve to minimize the protrusion (illustrated by distance "Y") of the pin members 28 outwardly of the wall 90 of concrete structure 92. As illustrated in FIG. 7, the second portion 24 of legs 16 and 20 has a zone of thermal expansion indicated by the measurement line "Z". The first portion 20 of each of the legs 16 and 20 has a much longer length than that of the second portion 24. The buttressing of the concrete 92 against the outer side 56 of second portion 24 will urge any thermal expansion effects upwardly toward the receiving area 12. As such, the long length of the first portion 22 will tend to force the receiving area 12 deeper into the concrete, as opposed to forcing the second portion 24 outwardly of the concrete. Because each of the legs 16 and 20 is a "bi-linear" leg, thermal expansion effects will act on the separate portions 22 and 24 differently. The first portion 22 will expand so as to urge the receiving area 12 deeper into the concrete. The second portion 24 will have thermal expansion effects that tend to urge the pin members 28 slightly out of the wall 90 of concrete 92. However, because the second portion 24 has only a minimal length, the amount of such thermal expansion will be rather minimal. The non-linear relationship between inner side 54 of the first portion 22 and the inner side 58 of the second portion 24 will also be resistive of thermal expansion of the first portion 22 toward the wall 90. Because the outer side 52 of the first portion 22 and the inner side 54 of the leg 16 converge toward the second portion 24, the concrete 92 will tend to compress the sides 52 and 54 of the first portion 16 and urge the receiving area 12 deeper into the concrete rather than transferring the forces toward the second portion 24. If, in the event that bond breaker is applied to the chair 10, the legs 16 and 20 will not "slide" through the concrete as would be the case with the legs 82 and 84, as illustrated in FIG. 6. The discontinuity between the first portion 22 and second portion 24 will tend to be resistive of any sliding of the legs 16 and 18 outwardly of the wall 90.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A chair comprising:

a receiving area suitable for receiving a surface of a rebar thereon;

a plurality of legs extending from said receiving area, each of said plurality of legs having a first portion extending outwardly and downwardly from said receiving area and a second portion extending from an end of said first portion opposite said receiving area, said second portion extending vertically, said first portion having a length substantially longer than a length of said second portion, said first portion having an inner side and an outer side, said second portion having an inner side and an outer side, said inner side of said first portion extending at an non-linear obtuse angle with respect to said inner side of said second portion; and a plurality of pin members respectively formed at a bottom of said legs, each of said plurality of pin members extending downwardly from a bottom of said second portion opposite said first portion so as to have a pointed or sharp end opposite said bottom of said second portion.

2. The chair of claim 1, each of said plurality of legs having a rectangular cross section.

3. The chair of claim 1, said outer side of said first portion extending at a non-linear obtuse angle with respect to said outer side of said second portion.

4. The chair of claim 1, each of said plurality of pin members extending at an angle from said inner and outer sides of said second portion, each of said plurality of pin members having a generally flat side.

5. The chair of claim 1, said inner and outer sides of said first portion converging toward said second portion.

6. The chair of claim 1, said inner and outer sides of said second portion being substantially parallel.

7. The chair of claim 1, said receiving area and said plurality of legs and said plurality of pin members being integrally formed together of a polymeric material.

8. A chair comprising:

a receiving area suitable for receipt of a portion of a rebar thereon; and a plurality of legs extending from said receiving area, each of said plurality of legs having a first portion extending at an angle outwardly and downwardly from said receiving area and a second portion extending downwardly from an end of said first portion opposite said receiving area, said first portion having an inner side and an outer side, said second portion having an inner side and an outer side, said inner side of said first portion extending at anon-linear obtuse angle with respect to said inner side of said second portion, said inner and outer sides of said first portion converging toward said second portion, said inner and said outer sides of said second portion being substantially parallel.

9. The chair of claim 8, further comprising:

a plurality of pin members respectively formed at a bottom of said plurality of legs, each of said plurality of pin members extending downwardly from a bottom of said second portion opposite said first portion so as to have a sharp or pointed end opposite said bottom of said second portion.

10. The chair of claim 8, said second portion extending entirely vertically downwardly from said end of said first portion.

11. The chair of claim 10, said first portion having a length substantially longer than a length of said second portion.

12. The chair of claim 8, each of said plurality of legs having a rectangular cross section.

13. The chair of claim 8, said outer side of said first portion extending at a non-linear obtuse angle with respect to said outer side of said second portion.

14. The chair of claim 9, each of said plurality of pin members extending at an angle from said inner and outer sides of said second portion, each of said plurality of pin members having a generally flat side.

15. The chair of claim 8, said receiving area and said plurality of legs being integrally formed together of a polymeric material.

16. A chair comprising:

a receiving area suitable for receipt of a portion of a rebar thereon;

a plurality of legs extending from said receiving area, each of said plurality of legs having a first portion extending at an angle outwardly and downwardly from said receiving area and a second portion extending downwardly from an end of said first portion opposite said receiving area, said first portion having an inner side and an outer side, said second portion having an inner side and an outer side, said outer side of said second portion extending entirely vertically and at a non-linear obtuse angle with respect to said outer side of said first portion; and a plurality of pin members respectively formed at a bottom of said plurality of legs, each of said plurality of pin members extending downwardly from a bottom of said second portion opposite said first portion so as to have a sharp or pointed end opposite said bottom of said second portion.

* * * * *